US008651127B2

(12) United States Patent
Arras et al.

(10) Patent No.: US 8,651,127 B2
(45) Date of Patent: Feb. 18, 2014

(54) METHOD FOR OPERATING A SANITARY TANK FOR A RAIL VEHICLE

(75) Inventors: Burkhard Arras, Krefeld (DE); Torge Kamphausen, Willich (DE); Guenther Schless, Wesel (DE)

(73) Assignee: Siemens Aktiengesellschaft, Munich (DE)

( * ) Notice: Subject to any disclaimer, the term of this patent is extended or adjusted under 35 U.S.C. 154(b) by 197 days.

(21) Appl. No.: 13/377,612

(22) PCT Filed: Jun. 1, 2010

(86) PCT No.: PCT/EP2010/057643

§ 371 (c)(1),
(2), (4) Date: Dec. 12, 2011

(87) PCT Pub. No.: WO2010/142577

PCT Pub. Date: Dec. 16, 2010

(65) Prior Publication Data

US 2012/0085417 A1 Apr. 12, 2012

(30) Foreign Application Priority Data

Jun. 12, 2009 (DE) ..... 10 2009 024 653

(51) Int. Cl.
*F17D 1/00* (2006.01)

(52) U.S. Cl.
USPC ..... 137/1; 137/2; 137/386

(58) Field of Classification Search
USPC ..... 137/1, 2, 386
See application file for complete search history.

(56) References Cited

U.S. PATENT DOCUMENTS

| | | | | |
|---|---|---|---|---|
| 2,632,308 | A * | 3/1953 | Engelhardt | 137/392 |
| 2,674,101 | A * | 4/1954 | Calling | 137/59 |
| 2,717,496 | A * | 9/1955 | Andersson | 137/392 |
| 3,360,951 | A * | 1/1968 | Hoenisch | 137/392 |
| 4,216,554 | A | 8/1980 | Glueckert et al. | |
| 4,217,762 | A * | 8/1980 | Sakamoto et al. | 62/132 |
| 4,249,388 | A * | 2/1981 | Burns | 141/159 |
| 4,903,506 | A * | 2/1990 | Delisle et al. | 62/347 |
| 5,555,747 | A * | 9/1996 | Conlon | 62/532 |
| 6,782,908 | B2 * | 8/2004 | Lee et al. | 137/392 |
| 7,806,152 | B2 * | 10/2010 | Dalton et al. | 141/314 |
| 7,930,893 | B2 * | 4/2011 | Coffey | 62/137 |
| 2007/0014680 | A1 * | 1/2007 | Gifford et al. | 137/1 |

(Continued)

FOREIGN PATENT DOCUMENTS

WO 97/46435 A1 12/1997

*Primary Examiner* — John Rivell
*Assistant Examiner* — Craig J Price
(74) *Attorney, Agent, or Firm* — Laurence A. Greenberg; Werner H. Stemer; Ralph E. Locher

(57) ABSTRACT

The invention relates to a method for operating a tank for receiving fluids in a sanitary system of a rail vehicle, wherein a) the fill level of the tank is registered; b) in the event that the fill level registered in step a) is equal to or greater than a fill level specified for the tank, ice formation is permitted for a time period specified for the tank; c) in the event that the fill level registered in step a) falls below the specified fill level, the tank is emptied; or d) in the event that the fill level registered in step a) falls below the specified fill level, the fill level is increased with fluid from a fresh water tank, and subsequently, steps b) or c) are carried out.

7 Claims, 1 Drawing Sheet

(56) References Cited

U.S. PATENT DOCUMENTS

2009/0211270 A1* 8/2009 Kim et al. ..... 137/386
2009/0288734 A1* 11/2009 Barcin et al. ..... 141/95
2013/0074521 A1* 3/2013 Joung et al. ..... 62/3.63

* cited by examiner

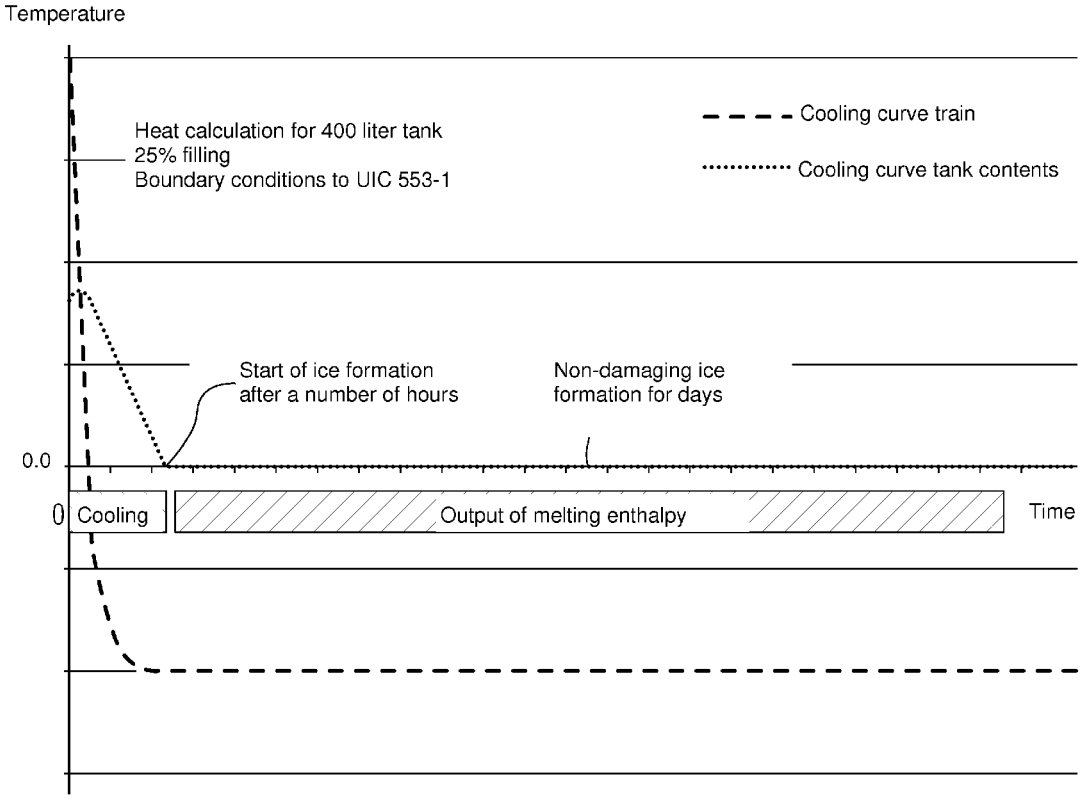
Temperature
Heat calculation for 400 liter tank
25% filling
Boundary conditions to UIC 553-1
Cooling curve train
Cooling curve tank contents
Start of ice formation
after a number of hours
Non-damaging ice
formation for days
0.0
0
Cooling
Output of melting enthalpy
Time

METHOD FOR OPERATING A SANITARY TANK FOR A RAIL VEHICLE

BACKGROUND OF THE INVENTION

Field of the Invention

The invention relates to a method for operating a tank for holding a liquid in a sanitary installation in a rail vehicle.

In rail vehicles, various tanks are used as components of the sanitary installation. Specifically, these are, for example, a fresh-water tank, a wastewater tank and a gray-water tank. All of these tanks should be protected from frost damage when the rail vehicle is operated in winter. In this connection, it is necessary to comply with regulations, for example International Union of Railways guidelines, which demand that the sanitary installations should remain operational within certain limits at outside temperatures below freezing, without suffering frost damage.

For this purpose, in known methods, in the case of correspondingly low outside temperatures, the tanks are heated with heating means which are installed in or on the thermally insulated fresh-water, gray-water or wastewater tank, in order to prevent the tanks from freezing. Connected pipelines are closed off and drained if they contain fresh water or gray water.

Such an operating method for tanks in sanitary installations involves a fair amount of outlay, since additional components, namely the heating means, have to be provided in order to avoid frost damage to the tanks.

BRIEF SUMMARY OF THE INVENTION

On this basis, it is the object of the invention to further develop a method for operating a tank of the type mentioned at the beginning such as to allow less outlay with regard to the tank installation while the necessary frost protection is provided.

This object is achieved by a method for operating a tank for holding a liquid in a sanitary installation in a rail vehicle, in which a) a degree of filling of the tank is sensed, b) if the degree of filling sensed in step a) is equal to or greater than a degree of filling predetermined for the tank, formation of ice is permitted over a period of time predetermined for the tank, c) if the degree of filling sensed in step a) falls below the predetermined degree of filling, the tank is emptied or d) if the degree of filling sensed in step a) falls below the predetermined degree of filling, the degree of filling is increased with liquid from a fresh-water container and subsequently step b) or c) is carried out.

The method is based on the fact that the tank is operated differently depending on whether the degree of filling falls below or exceeds the predetermined degree of filling. It is taken into account in step b) that a well-filled tank allows a certain formation of ice without suffering frost damage. By contrast, tanks with a low degree of filling are likely to suffer frost damage much more quickly, and so in this case method step c) or d) is carried out.

The predetermined degree of filling is selected specifically for the tank in question, which is operated according to this method, such that said degree of filling ensures that the tank is frost-proof for a relevant outside temperature range which may depend on the use conditions of the rail vehicle or can be taken from regulations, for example International Union of Railways guidelines, for a sufficiently long period of time, which typically lasts several dozen hours.

Specifically, the predetermined degree of filling is selected in a manner specific to the tank and dependent on the tank size and tank insulation and dependent on a relevant outside temperature range. It is conceivable for the predetermined degree of filling to be determined first of all empirically for a particular tank, with the value determined in this way being used in the method presented here for operating a tank.

Generally, substantially independently of the type of tank, the predetermined degree of filling may be between 5% and 60%.

Following step b), c) or d), if the tank is a fresh-water tank, the tank may be refilled in order to continue operation.

A different procedure should be adopted for wastewater tanks and gray-water tanks; in this case, following step b), in order to continue operation, the tank may be filled up, for example to at least 90%, via a flushing connection, and subsequently be emptied.

In the case of a wastewater tank or gray-water tank which was emptied after step c), operation can be continued.

BRIEF DESCRIPTION OF THE DRAWING

An exemplary embodiment of the invention is explained in more detail in the following text with reference to the drawing. The single FIGURE shows a graph illustrating non-damaging formation of ice for an exemplary tank having a volume of 400 liters and a predetermined degree of filling x=25%.

DESCRIPTION OF THE INVENTION

In the graph illustrated in the FIGURE, the temperature is indicated on the Y-axis in arbitrary units and the time is indicated on the X-axis, likewise in arbitrary units. A dashed line shows the temperature profile for a rail vehicle as a whole, in which the tank in question here is installed, while a dotted line represents a cooling curve for tank contents.

It is apparent that the cooling curve for the rail vehicle as a whole drops heavily early on and then remains constant at a distance from the freezing point 0° C. By contrast, the temperature of the tank contents drops less steeply to the freezing point and then remains there. Ice begins to form in the tank after the freezing point has been reached, and this typically lasts for several hours. After this cooling phase, there starts a phase in which the melting enthalpy within the tank is output, and this contributes to non-damaging ice formation occurring for a sufficiently long period of time, which is typically several dozen hours. The time period for which no frost damage to the tank should be expected depends substantially on the insulation of a tank, the time profile of the ambient temperature and the filling of a tank (filling level and medium).

Within the meaning of an operating method for ensuring frost protection for the tank, the degree of filling of 25% assumed here for the heat calculation illustrated is a degree of filling which is equal to or above a predetermined degree of filling, at which ice formation is allowed over a period of time predetermined for the tank.

In this case, the degree of filling of any desired tanks can be either sensed automatically or set manually. If the degree of filling falls below the degree of filling predetermined for the tank, possibly even after step d) has been carried out, the tank is emptied as per step c).

The method presented makes it possible for a component, namely the tank heating means, of a water installation in the rail vehicle to be dispensed without further components being added. The degree of filling of a fresh-water tank is usually measured anyway, and in the case of a wastewater or gray-water tank, the degree of filling has to be determined if appropriate in some other way.

In addition to the reduction in costs for additional heating components, advantages are also achieved with regard to energy consumption, demands on the on-board power supply, water quality (if the heating means was installed in the tank), replacement parts and maintenance.

The invention claimed is:

1. A method for operating a tank for holding a liquid in a sanitary installation in a rail vehicle, which comprises the steps of;

a) sensing a degree of filling of the tank;

b) permitting a formation of ice over a period of time predetermined for the tank if the degree of filling sensed in the step a) is equal to or greater than a predetermined degree of filling for the tank;

c) emptying the tank if the degree of filling sensed in the step a) falls below the predetermined degree of filling; and d) increasing the degree of filling with the liquid from a fresh-water container if the degree of filling sensed in the step a) falls below the predetermined degree of filling, and subsequently carrying out one of the steps b) or c).

2. The method according to claim 1, which further comprises selecting the predetermined degree of filling in a manner specific to the tank and dependent on a tank size, tank insulation and on a relevant outside temperature range.

3. The method according to claim 1, which further comprises setting the predetermined degree of filling to be between 5% and 60%.

4. The method according to claim 1, which further comprises following the step b), c) or d), refilling the fresh-water tank in order to continue operation, if the tank is a fresh-water tank.

5. The method according to claim 1, which further comprises following the step b), in order to continue operation, if the tank is a wastewater tank or a gray-water tank via a flushing connection, and is subsequently emptied.

6. The method according to claim 1, wherein if the tank is a wastewater tank or a gray-water tank which was emptied after the step c), continuing operation.

7. The method according to claim 1, which further comprises following the step b), in order to continue operation, if the tank is a wastewater tank or a gray-water tank, filling the tank up to at least 90%, via a flushing connection, and is subsequently emptied.

* * * * *